US005346220A

United States Patent [19]

Cooper et al.

[11] Patent Number: 5,346,220

[45] Date of Patent: Sep. 13, 1994

[54] GOLF CLUB SWING PRACTICE DEVICE

[76] Inventors: Patrice A. Cooper, 9325 Olympia Dr., Eden Prairie, Minn. 55347; H. Jo-Ann Lindsay, 2 Merilane, Edina, Minn. 55436

[21] Appl. No.: 128,563

[22] Filed: Sep. 28, 1993

Related U.S. Application Data

[63] Continuation of Ser. No. 988,234, Dec. 9, 1992, abandoned.

[51] Int. Cl.[5] ..... A63B 69/36

[52] U.S. Cl. ..... 273/191 R; 273/187.6

[58] Field of Search ..... 273/191 R, 191 A, 191 B, 273/192, 186.1, 187.1, 187 R, 187.6, 187 A; 434/252; D21/234

[56] References Cited

U.S. PATENT DOCUMENTS

| | | | |
|---|---|---|---|
| D. 117,600 | 11/1939 | Schneider | D21/234 |
| D. 186,846 | 12/1959 | Olson | D21/234 |
| 1,409,688 | 3/1922 | Edgar | 273/186 |
| 1,637,339 | 8/1927 | Glennon et al. | 273/191 |
| 3,125,343 | 3/1964 | Price et al. | 273/191 X |
| 3,341,208 | 9/1967 | Marcella | 273/191 A |
| 3,427,031 | 2/1969 | Scott | 273/191 R X |
| 3,460,837 | 8/1969 | Cassa | 273/191 R X |
| 3,482,838 | 12/1969 | Gibson et al. | 273/191 |
| 3,550,946 | 12/1970 | Menendez | 273/187 R X |
| 3,868,109 | 2/1975 | Fowler | 273/187 A |
| 3,942,802 | 3/1976 | Wright | 273/192 X |
| 4,023,811 | 5/1977 | De Cota | 273/191 X |
| 4,779,872 | 10/1988 | Bisbee | 273/187 R X |
| 4,869,510 | 9/1969 | Battersby | 273/191 R X |
| 4,930,786 | 6/1990 | Bencrisutto | 273/187 A X |
| 5,263,719 | 11/1993 | Bunn | 273/191 R X |

*Primary Examiner*—George J. Marlo

*Attorney, Agent, or Firm*—Merchant, Gould, Smith, Edell, Welter & Schmidt

[57] ABSTRACT

A golf instruction device is disclosed which teaches golfers to learn and execute an inside-out swing. The device consists of a horizontal base that is placed on a supporting surface such as the ground or floor in a practice tee area. A guiding member that guides club head movement during the swing projects upwardly from the base and includes three guide sections. The first is a straight section that lies on the line of intended ball movement, the second extends rearwardly from the first section and curves inwardly relative to the golfer, and the third section is straight, extending forwardly from the first section but diverges outwardly or away from the golfer. By following the three guiding sections during the backswing and foreswing, the golfer learns to execute the inside-out swing properly.

17 Claims, 3 Drawing Sheets

GOLF CLUB SWING PRACTICE DEVICE

This is a continuation, of application Ser. No. 07/988,234, filed Dec. 9, 1992 now abandoned.

BACKGROUND OF THE INVENTION

The invention is directed to a device that helps golfers learn and repetitively use a proper golf swing.

The golf swing is difficult to learn and master because it is highly complex and involves a number of factors that the golfer must execute in order to accomplish the objective of hitting the ball accurately with the desired distance. These factors include foot placement relative to the ball, grip and hand location on the club, body orientation and position, hand and arm position and movement during the backswing and foreswing, head and eye position during the swing, tempo or pace of the swing, weight balance and shift during the backswing and foreswing, club head speed and follow through.

For most beginners and intermediate players, trying to remember each of these factors is difficult enough, and executing them properly becomes an all but impossible task. Post analysis of the swing by the golfer is generally quite difficult due to the number of factors involved, although the use of video recording equipment and/or the observation of a golf professional during a lesson can constructively draw the golfer's attention to the problems encountered during the swing. However, during a round of play, hitting the ball consistently and accurately remains an elusive objective for the vast majority of players.

One of the most pronounced and frustrating problems encountered by golfers is the golf shot created by and outside-to-inside club head path; i.e., a "slice" in which the ball curves to the right from the intended flight path for right-hand golfers.

An outside-to-inside club head path can result from one or a combination of factors including incorrect grip, improper orientation to the ball, incorrect club head takeaway (the club head moves to the outside during the backswing), lack of shoulder turn, improper weight transfer or lack of weight transfer. Each of these factors is capable of causing the club head to follow an outside-to-inside path, thus preventing the golfer from achieving a golf shot with maximum accuracy and distance.

It has been determined through longstanding experience that the use of a golf swing in which the club head moves "inside-outside" helps cure many of the problems that plague golfers. The inside-out swing, which is employed by many touring and club professionals as well as amateurs in the expert category, causes the head of the club to move straight back and then to curve inward (i.e., around and behind the golfer) on the backswing. As the downswing begins, the club is rerouted to a path that diverges away or outward from the golfer, resulting either in a straight flight of the ball or a desirable "draw"; i.e., a controlled and limited flight curvature in which the ball moves from right to left for the right-handed golfer.

While the inside-out swing avoids many problems in the golf swing, it is extremely difficult for golfers to learn.

Our invention is the result of an endeavor to create and develop a device that teaches golfers to learn and execute the inside-out swing. The device, which is lightweight and portable, consists of a base that can be placed on the ground (e.g., on the practice tee area) or on the floor of an inside practice area. A guide is carried by and projects upwardly from the base and includes three horizontal guide sections. The first is a straight section which lies parallel to the line of the intended flight path and includes a marking that defines where the point of ball impact will occur. The second section extends rearwardly from the straight section and curves inwardly relative to the golfer. The third section is also straight and extends forwardly from the leading point of the first section. However, rather than extending in the line of intended ball movement, it diverges outwardly or away from the golfer.

In use, the golfer places the ball at the leading point of the straight first section and positions his/her feet relative to the ball and the first section (i.e., the golfer's feet are oriented relative to the intended line of flight). The golfer then begins the club backswing, using the first and second sections, which cause the club head to initially move straight back along the first section and then to curve inwardly to conform to the second section. At the rear most point of the second section, the club head has moved inwardly of the intended line of ball movement; i.e., around and behind the golfer's backswing side. From this point, the golfer begins the downswing with the objective of impacting the ball on an inside-to-outside path by rerouting the club head to a path that is parallel with the forward or third section. At impact, the club head moves down the intended flight path, having been squared to the impact area by proper forearm rotation. This creates a flight path that is either straight or has a slight draw.

In using the guide in this manner, it will be appreciated that during the backswing the club head is not only positioned properly (i.e., it is moved inward from the intended line of the flight path), but also the golfer's arms are encouraged to stay in correct position relative to the body. Using the guide as directed forces a proper turn away from the ball along with a resulting correct shift of weight to the inside of the back foot. This facilitates the proper position for the start of the downswing on the desired inside-to-outside path. As the golfer moves from this "inner" portion of the swing through impact to the follow through, the club head squares itself at impact with the proper forearm rotation. The "out-to-in" club head movement that imparts a slicing spin is not only avoided but precluded, and the ball moves either straight at the target or with a slight draw.

Use of the inventive golf instructing device repeatedly on the practice tee will result in a programmed swing; i.e., one which becomes automatic to the golfer. The golfer thus avoids having to think through each of the many fundamental factors involved in the swing, and need concentrate only on properly using the three guide sections of the device.

With proper use and practice the inventive golf instructing device enables even a beginning golfer to readily learn the "inside-out" swing, increasing both length, accuracy and enjoyment of the game.

BRIEF DESCRIPTION OF THE DRAWINGS

FIG. 4 is a top plan of the golf instruction device, showing the golfer's feet oriented properly and also showing club head movement during the backswing, at impact and during the follow through.

DETAILED DESCRIPTION OF THE PREFERRED EMBODIMENT

Figure 1:
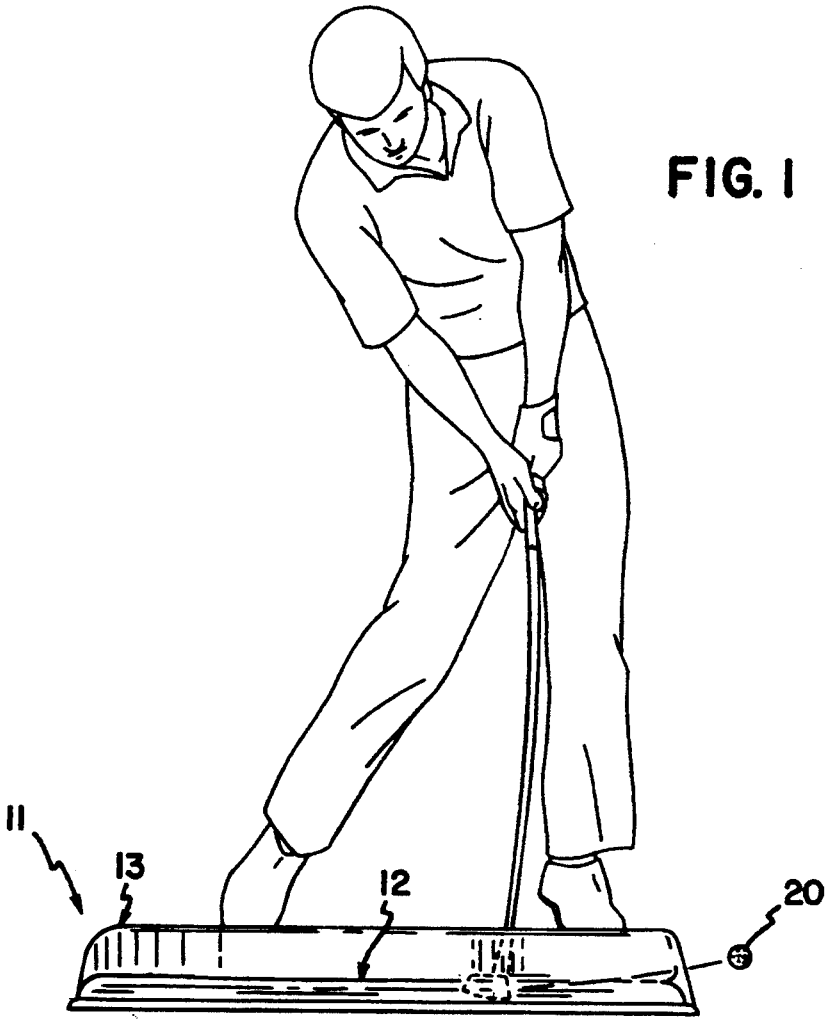
FIG. 1 is a side elevation view of the inventive golf instruction device as used by a golfer.
Figure 2:
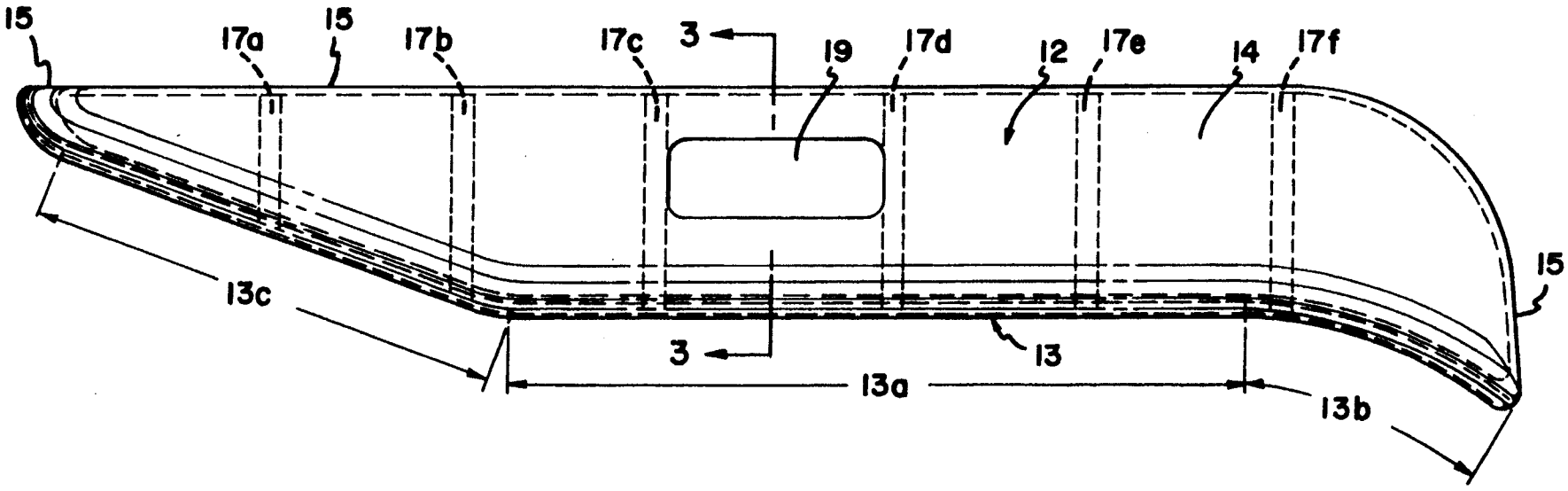
FIG. 2 is a top plan view of the golf instruction device.
Figure 3:
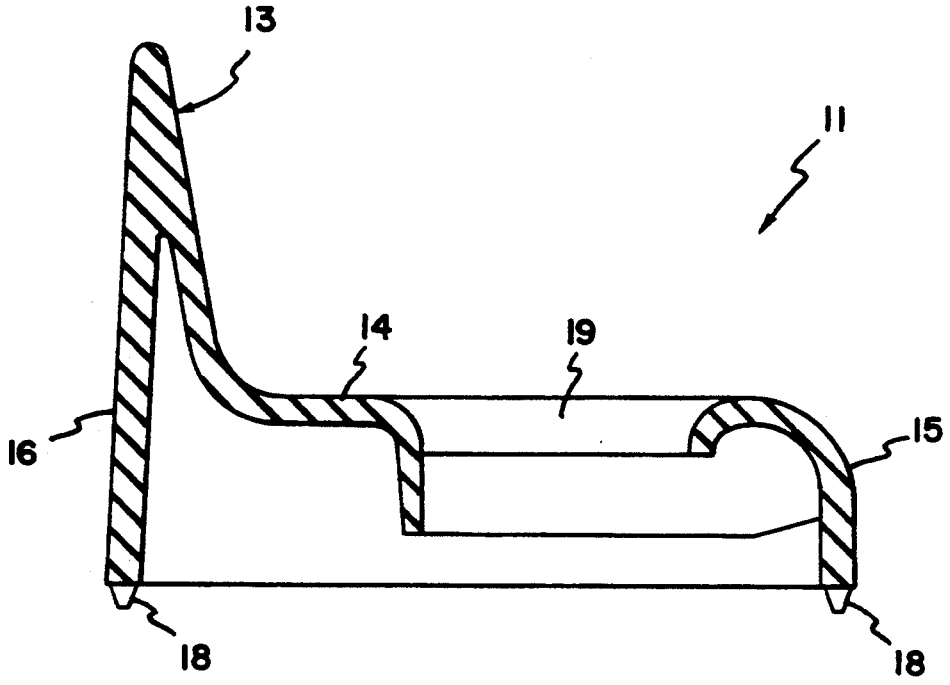
FIG. 3 is a transverse sectional view of the golf instruction device taken along the line 3—3 of FIG. 2.

With initial reference to FIGS. 1–3, a device for instructing the use of a proper golf swing is represented generally by the numeral 11. Device 11 is constructed for use by a right-handed golfer. It will be apparent from the description below that a device for a left-handed golfer would constitute a mirror image of the device 11.

Golf instruction device 11 generally comprises a base portion 12 that is adapted to be placed and rest stably on the ground or floor of a practice tee area, and a guide 13 that projects upward from the base 12 and extends generally horizontally over the length of the device.

More specifically, and with reference to FIGS. 2 and 3, base 12 includes a large, substantially flat platform 14 that is of irregular shape and having a greater length than width. Platform 14 is elevated from the supporting surface by a downwardly projecting curb or leg portion 15 that extends continuously around the backside of the platform from the extreme left to the extreme right end (FIG. 2). As shown in FIG. 3, the upright guide 13 includes a downwardly projecting leg 16 that extends along the front side of the device from the left to the right end. A plurality of transverse reinforcing ribs 17*a*–17*f* project downwardly from the underside of platform 12 (although not sufficiently to reach the ground or other supporting surface) to provide reinforcement and strength to the device 11. To prevent device 11 from moving on its supporting surface, pointed feet 18 are included at spaced intervals along the bottom edge of curb 15 and leg 16.

With reference to FIGS. 2 and 3, a longitudinally extending rectangular opening 19 is formed through platform 14 at approximately its center point. The opening 19 serves as a handle for carrying device 11, and to that end, it is formed by a downwardly projecting wall 20 (FIG. 3) which is rounded, particularly adjacent curb 15, to facilitate comfortably grasping the device 11. For strength and stability, opening 19 is bounded at its longitudinal ends by transverse reinforcing ribs 17*c* and 17*d*, respectively.

As will be appreciated from the construction described above, device 11 readily lends itself to manufacture by molding from rubber or similar resilient material. It is also possible to manufacture device 11 from plastic by injection molding, but more resilient materials such as rubber are more desirable because the device requires some degree of resiliency when inadvertently struck by a golf club as well as increased weight for position retention and stability.

Guide 13 extends along the front side of device 11, extending continuously from the left to the right end. As shown on FIG. 3, guide 13 projects substantially vertically, merging from an upward bend of platform 14 and leg 16 (FIG. 3).

With reference to FIG. 2, guide 13 specifically comprises three interconnected but functionally separate sections 13*a*–13*c* that together serve to guide the golf club head in a manner which accomplishes an "inside-out" swing. Section 13*a* is disposed between sections 13*b* and 13*c* and is substantially straight in the preferred embodiment. Section 13*a* is intended to lie on the line of intended ball movement, and the ball is positioned at its left end at about the juncture with section 13*c* (see the position of golf ball 20 in the reversed FIG. 4). Section 13*a* defines the line of initial club head movement during the initial backswing or takeaway, which should be straight.

Section 13*b* consists of a curved segment that bends inwardly relative to the golfer; i.e., around and behind the golfer. Section 13*b* is intended to force the golfer to bring the club head inward as it leaves section 13*a* during the backswing. Section 13*b* does not extend to the rear most point of the golfer's backswing since the club head must necessarily be elevated at the same time it is brought along section 13*b*. However, section 13*b* initiates the curved movement of the club head that is necessary to accomplish the remaining portion of the "inside-out" swing.

Section 13*c* extends horizontally forward from section 13*a*, but at an angle that diverges from the line of intended ball movement. It will be observed that section 13*b* curves away from the line of intended ball movement on one side thereof (inward), while section 13*c* extends angularly from the line of intended ball movement on the side opposite that of section 13*b* (outward). If a line were drawn which extended rearwardly along the line defined by section 13*c*, it would theoretically intersect the point of the golfer's backswing at which the foreswing begins. Stated otherwise, as the club head moves rearwardly through the guided curvature of section 13*b* during the backswing, it reaches a point that is aligned with section 13*c*, and the objective is for the club head to be brought forward from that point during initiation of the foreswing in alignment with section 13*c*. Because the foreswing of the club naturally follows an arcuate path, the club head cannot continue in alignment with the line of section 13*c* after impact with the ball, but proper foreswing initiation along this line will result in an inside-out swing as described below.

Figure 4:
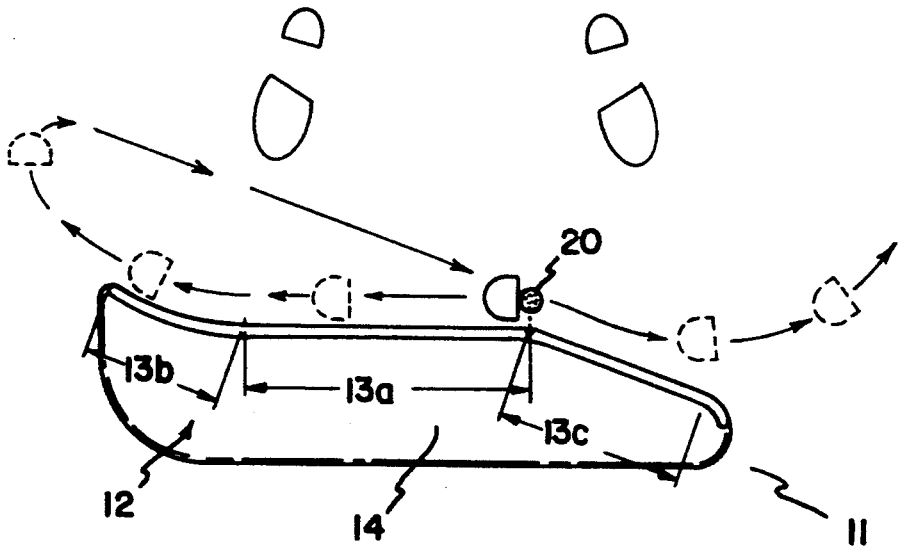

The intended guided movement of the golf club head during use of the device 11 is shown in FIG. 4. Initially, the golfer places a golf ball 20 at the most forward point of section 13*a* and addresses the device 11 and ball 20 with feet properly oriented. As shown in FIG. 4, proper foot orientation is with the feet slightly spread and the toes lying on a line that is parallel with section 13*a* and the intended line of ball movement. If the golf club is a driver, the golfer's feet are preferably positioned so that the ball 20 is slightly inside the golfer's lead foot (i.e., the right-handed golfer's left foot).

The club head represented by solid lines in FIG. 4 represents a club head at the beginning of the golf swing, and the club face is oriented in a position that is substantially perpendicular with the intended line of ball movement. From this position, the backswing begins with the club head being taken back directly along the straight section 13*a*. This movement is represented by the arrowed line shown in FIG. 4. Although the club head takeaway is straight back, the club head itself begins to rotate inwardly as the result of proper hand and forearm movement.

As the club head reaches the junction with section 13*b*, the golfer must initiate inward movement in conformance to the curvature of section 13*b*. This inward curved movement continues in the backswing, which forces the golfer's right elbow against his or her right side, thus ensuring that the club head will not be opened at the point of impact.

As the golfer continues this inward movement during the backswing, he/she now begins to concentrate on the straight divergent section 13*c*, and the backswing stops at the point the golfer senses that the club head can now be brought straight forward along the arrowed line that extends rearwardly from the section 13*c*. The foreswing is initiated at this point, the golfer's weight is shifted to the forward or lead foot, and the club head moves along the forward arrowed line and impacts the ball 20. As the club head continues after impact with the ball, the golfer's natural body movement prevents the club head from following section 13*c*, and the follow through, as indicated by the forward arrows after ball impact, results in arcuate movement of the club head in the inside direction. It is reiterated that the club head does not actually follow section 13*c* after impact with the ball, and that the purpose of section 13*c* is to provide a visual guide to the golfer to determine the line of club head movement from initiation of the foreswing to the point of ball impact.

The "inside-out" swing described above, as influenced by the device 11, results in a ball flight path that is straight and aligned with the guide section 13*a*. By exaggerating the "inside-out" swing, it is possible for the golfer to "draw" the ball; i.e., cause the ball to move through a controlled or limited curve from right to left for the right-handed golfer.

The dimensions of the golf instruction device 11 may vary depending on the size of the golfer and the length of the club used. The preferred embodiment has a guide 13 that is approximately four inches in height. The guide section 13*a* is 17 inches in length, curved guide section 13*b* is approximately 7.5 inches in length, and divergent or angled section 13*c* is approximately 11 inches in length. The angle subtended between the sections 13*a* and 13*c* in the preferred embodiment is approximately 20 degrees, and the curvature of section 13*b* is based on a radius of approximately 10 inches. The overall length of device 11 is approximately 35 inches and its maximum width is between 5 and 6 inches.

It will be appreciated that the device 11 represents only the preferred embodiment of the invention, and that other embodiments may be devised to define the three guide sections instrumental in guiding the golf club through the desired "inside-out" swing.

What is claimed is:

1. A golf instruction device, comprising:

a substantially horizontal base adapted to rest on a supporting surface such as the ground or floor in a practice tee area; and club guiding means projecting upwardly from the base in a position to guide the head of a user's golf club and comprising:

a first guiding section that is substantially straight and capable of being oriented along the line of intended golf ball movement;

a second guiding section that projects rearwardly from the first guiding section along the line that curves away from said line of intended golf ball movement on one side thereof; and a third guiding section that projects forwardly from the first guiding section along a substantially straight line that extends angularly away from the line of intended golf movement on the opposite side thereof.

2. The device defined by claim 1, wherein the base comprises a substantially flat platform of greater length than width.

3. The device defined by claim 2, wherein the first, second and third guiding sections project upwardly from the platform along one side thereof.

4. The device defined by claim 3, which further comprises foot means for elevating the platform above its supporting surface.

5. The device defined by claim 4, wherein the foot means comprises a plurality of spaced feet projecting downwardly from the base for engagement with the support surface.

6. The device defined by claim 2, wherein an opening is formed through said platform at a substantially central portion thereof, the opening defining a handle for carrying the device.

7. The device defined by claim 3, wherein the base further comprises a plurality of transverse strengthening ribs projecting from the underside of the platform.

8. The device defined by claim 1, wherein the first, second and third guiding sections are interconnected to define a continuous guiding member.

9. The device defined by claim 1, wherein the juncture of the first and third guiding sections defines the point at which the golf ball is placed.

10. The device defined by claim 1, wherein the base and club guiding means are integrally formed from a resilient material.

11. The device defined by claim 10, wherein said resilient material is rubber.

12. The device defined by claim 1, wherein the angle subtended between the first and third sections is about 20 degrees.

13. The device defined by claim 1, wherein the first guide section is approximately 17 inches in length, the second guide section is approximately 7 and one-half inches in length, and the third guide section is approximately 11 inches in length.

14. The device defined by claim 13, wherein the height of the first, second and third guiding sections is approximately 4 inches.

15. The device defined by claim 1, wherein the curvature of the second guide section is based on a radius of approximately 10 inches.

16. A device for guiding a golf club through a proper golf swing, the device being adapted to be supported by the ground or floor in a practice tee area, and comprising:

a first guiding section that is substantially straight and capable of being oriented along the line of intended golf ball movement;

a second guiding section that projects rearwardly from the first guiding section along a line that curves away from said line of intended golf ball movement on one side thereof; and a third guiding section that projects forwardly from the first guiding section along a substantially straight line that extends angularly away from the line of intended golf movement on the opposite side thereof.

17. The device defined by claim 16, wherein the first, second and third guiding sections are interconnected to define a continuous guiding member.

* * * * *